United States Patent [19]

Nakayama et al.

[11] Patent Number: 4,515,351

[45] Date of Patent: May 7, 1985

[54] METHOD AND APPARATUS FOR MANUFACTURING NON-FIRED IRON-BEARING PELLET

[75] Inventors: Michio Nakayama, Kawasaki; Osamu Tajima, Kamakura; Seiji Matsui, Kawasaki; Hideyuki Yoshikoshi, Hino; Hiroshi Fukuyo, Yokohama, all of Japan

[73] Assignee: Nippon Kokan Kabushiki Kaisha, Tokyo, Japan

[21] Appl. No.: 558,758

[22] Filed: Dec. 6, 1983

Related U.S. Application Data

[62] Division of Ser. No. 366,199, Apr. 7, 1982, Pat. No. 4,432,788.

[30] Foreign Application Priority Data

Apr. 23, 1981 [JP] Japan ..... 56-60640
Apr. 23, 1981 [JP] Japan ..... 56-60641

[51] Int. Cl.[3] ..... C22B 1/08

[52] U.S. Cl. ..... 266/177; 266/178; 266/197

[58] Field of Search ..... 266/177, 197, 156, 178, 266/180; 75/3

[56] References Cited

U.S. PATENT DOCUMENTS

| | | | |
|---|---|---|---|
| 2,948,521 | 8/1960 | Heiligenstaedt | 266/177 |
| 3,005,699 | 10/1961 | Enck et al. | 266/156 |
| 3,877,868 | 4/1975 | Wenzel et al. | 75/3 |
| 4,049,435 | 9/1977 | Lotosh et al. | 75/3 |
| 4,332,551 | 6/1982 | Haslmayr et al. | 75/3 |

FOREIGN PATENT DOCUMENTS

| | | |
|---|---|---|
| 2766677 | 11/1979 | Australia . |
| 2766777 | 11/1979 | Australia . |
| 2004664 | 11/1969 | France . |

OTHER PUBLICATIONS

D. F. Ball et al., "Agglomeration of Iron Ores", 1973, Am Elsevier Pub. Comp. Inc., New York, pp. 308–313.

*Primary Examiner*—L. Dewayne Rutledge
*Assistant Examiner*—S. Kastler
*Attorney, Agent, or Firm*—Frishauf, Holtz, Goodman & Woodward

[57] ABSTRACT

A treating furnace for manufacturing non-fired iron-bearing pellets comprising a green iron-bearing pellet inlet at one end thereof and a non-fired iron-bearing pellet outlet at the other end. Green iron-bearing pellets are continuously fed into the treating furnace through said inlet and after being heated are discharged through said outlet. The treating furnace contains at least one heating gas blowing port for blowing heating gas into the furnace and at least one heating gas discharge port for discharging said gas after it has heated the pellets. The furnace also contains a preheating zone and at least one preheating gas blowing port and at least one preheating gas discharge port to pass preheating gas through said preheating zone. The heating gas discharged from the heating gas discharge port is used as the preheating gas. The gas discharged from the heating gas discharge port is admixed with the gas discharged from the preheating gas discharge port and then the thus mixed gas is utilized as the feed preheating gas to the preheating gas blowing (inlet) port.

3 Claims, 8 Drawing Figures

METHOD AND APPARATUS FOR MANUFACTURING NON-FIRED IRON-BEARING PELLET

This is a division of application Ser. No. 366,199 filed Apr. 7, 1982 now U.S. Pat. No. 4,432,788.

REFERENCE TO PATENTS, APPLICATIONS AND PUBLICATIONS PARTINENT TO THE INVENTION

As far as we know, there is available the following prior document pertinent to the present invention:

(1) Japanese Patent Publication No. 29688/72 dated Aug. 3, 1972.

The content of the prior art disclosed in the above prior document will be described hereinafter under the heading of the "Background of the Invention".

FIELD OF THE INVENTION

The present invention relates to a method and an apparatus for manufacturing a non-fired iron-bearing pellet, which comprises manufacturing a non-fired iron-bearing pellet by hardening in a non-firing manner a green iron-bearing pellet prepared through addition of a hydraulic binder and water to raw materials which comprise at least one of an iron ore fine and a dust mainly comprising iron oxides.

BACKGROUND OF THE INVENTION

The methods for manufacturing an iron-bearing pellet or an iron-bearing briquette (hereinafter referred to as "iron-bearing pellet") include the firing method and the non-firing method from a green iron-bearing pellet or a green iron-bearing briquette (hereinafter referred to as "green iron-bearing pellet") prepared by forming into a granular or pebble form a mixture obtained through addition of a binder to raw materials which comprise at least one of an iron ore fine and a dust mainly comprising iron oxides.

The non-firing method for manufacturing an iron-bearing pellet comprises continuously supplying a green iron-bearing pellet containing a hydraulic binder and water into a treating furnace, blowing a gas at a temperature of for example 100° C. into the treating furnace to heat the green iron-bearing pellet therein to a target temperature, and holding the green iron-bearing pellet at the target temperature for a prescribed period of time to harden the green iron-bearing pellet. Therefore this manufacturing method is more advantageous than the method for manufacturing an iron-bearing pellet through firing of a green iron-bearing pellet at a high temperature of over 1,000° C. in that it requires a smaller consumption of energy and simpler operations.

In the heat balance in the case where a green iron-bearing pellet supplied to a treating furnace is heated through blowing of a gas at a prescribed temperature, when disregarding the thermal loss occurring in the furnace, the heat absorbed by the green iron-bearing pellet is equal to the heat released by the gas blown to the green iron-bearing pellet, as expressed in the following equation (1):

$$C_s M_s (T_{s1} - T_{so}) = \int_o^\tau C_g F (T_{go} - T_{g1}) dt \quad (1)$$

where $C_s$: specific heat of the green iron-bearing pellet (Kcal/kg.°C.);

$M_s$: mass of the green iron-bearing pellet (kg);

$T_{so}$: charging temperature of the green iron-bearing pellet (°C.);

$T_{s1}$: heating temperature of the green iron-bearing pellet (°C.);

$C_g$: specific heat of the gas (Kcal/Nm$^3$.°C.);

F: flow rate of the gas (Nm$^3$/Hr);

$T_{go}$: blowing temperature of the gas (°C.);

$T_{g1}$: discharge temperature of the gas (°C.);

$\tau$: staying time of the green iron-bearing pellet in the furnace (Hr); and, $$\int_o^\tau C_g F (T_{go} - T_{g1}) dt:$$

integral value of the function $C_g F(T_{go} - T_{g1})$ in a time interval of from start of heating to $\tau$, and when the above function is any constant, the above integral value become the product of the above function and $\tau$.

The left-hand side of the above-mentioned equation (1) is dependent solely on the quantity of green iron-bearing pellet to be treated and the heating temperature, and irrespective of the heating method of green iron-bearing pellet. It is therefore necessary to set the right-hand side of the equation (1) at a value equal to that of the left-hand side. In this case, in order to minimize the gas flow rate F or the integral value thereof $F_\tau$, it is necessary to increase the gas blowing temperature $T_{go}$, whereas, in order to reduce the gas blowing temperature $T_{go}$, it is necessary to increase the gas flow rate F or the integral value thereof $F_\tau$. More particularly, in order to reduce the flow rate of the gas for heating the green iron-bearing pellet supplied to the treating furnace, it is necessary to blow the gas at a temperature higher than the heating target temperature of the green iron-bearing pellet. When the gas blowing temperature cannot be increased, on the other hand, it is necessary to increase the gas flow rate.

A method for manufacturing a non-fired iron-bearing pellet in a short time, in which a green iron-bearing pellet supplied in a treating furnace is subjected to a non-firing treatment to harden the same, is disclosed in Japanese Patent Publication No. 29688/72 dated Aug. 3, 1972 (hereinafter referred to as the "prior art").

The prior art discloses the method comprising: supplying a green iron-bearing pellet into a treating furnace, and blowing a steam at a temperature ranging from 160° to 230° C. into said treating furnace to heat said green iron-bearing pellet and thereby hardening the same to manufacture a non-fired iron-bearing pellet.

However, in the prior art, since the temperature of the gas (steam) to be blown into the treating furnace is increased to over the heating target temperature of the green iron-bearing pellet, overheating occurs in part of the above-mentioned green iron-bearing pellet first brought into contact with this gas, and water contained in this part of the green iron-bearing pellet is evaporated. As a result, this part of the green iron-bearing pellet does not give a proper hydration reaction, resulting in a lower product quality.

On the other hand, a higher flow rate of the gas blown into the treating furnace leads to a higher manufacturing cost. When, for example, one ton of a green iron-bearing pellet of a temperature of 30° C. is heated by blowing a gas to increase the temperature of the green iron-bearing pellet by 60° C. to a heating target temperature of 90° C. of the green iron-bearing pellet on condition that an initial temperature of the blown gas is set at 100° C. which is higher by 10° C. than the target temperature and a discharge temperature of the blown gas after heating of the green iron-bearing pellet is set at 90° C., the quantity of the gas required for heating the green iron-bearing pellet to said target temperature would be so large as 3,000 $Nm^3$ per ton of the green iron-bearing pellet as follows as calculated by the above-mentioned equation (1):

$$\underset{(C_s)}{0.16} \times \underset{(M_s)}{1000} \times \underset{(T_{sl} - T_{so})}{60} = \underset{(C_g)}{0.32} \times F_T \times \underset{(T_{go} - T_{gl})}{10}$$

$$F_T = 3{,}000$$

Under such circumstances, when manufacturing a non-fired iron-bearing pellet hardened through non-firing treatment of a green iron-bearing pellet, there is a strong demand for developing a method and an apparatus which permit manufacture of a high-quality non-fired iron-bearing pellet in a short time at a low cost, but such a method and an apparatus are not as yet proposed.

SUMMARY OF THE INVENTION

A principal object of the present invention is therefore to provide a method and an apparatus for manufacturing a non-fired iron-bearing pellet, which permit manufacture of a high-quality non-fired iron-bearing pellet in a short time at a low cost when manufacturing a non-fired iron-bearing pellet through heating of a green iron-bearing pellet in a treating furnace by a gas at a prescribed temperature blown into the treating furnace.

In accordance with one of the features of the present invention, there is provided apparatus for manufacturing a non-fired iron-bearing pellet, which comprises:

means for adding a hydraulic binder and water to main raw materials which comprise at least one of an iron ore fine and a dust mainly comprising iron oxides, and mixing same; the resultant mixture being formed into a green iron-bearing pellet; means for continuously supplying said green iron-bearing pellet into a treating furnace; means for blowing a gas at a prescribed temperature into said treating furnace to heat said green iron-bearing pellet to a target temperature; and, means for maintaining said green iron-bearing pellet at said target temperature for a prescribed period of time to harden said green iron-bearing pellet, thereby continuously manufacturing a non-fired iron-bearing pellet;

characterized in that:

said target temperature for heating a green iron-bearing pellet is set within the range of from 50° to 100° C.;

said gas contains saturated steam, and the temperature of said gas is substantially equal to said target temperature;

whereby at least part of said steam contained in said gas generates heat of condensation by condensation through heat exchange with the green iron-bearing pellet in said treating furnace, and thus, heat of said gas lost through said heat exchange with said green iron-bearing pellet is replenished with said condensation heat.

DETAILED DESCRIPTION OF THE PREFERRED EMBODIMENTS

Figure 2:
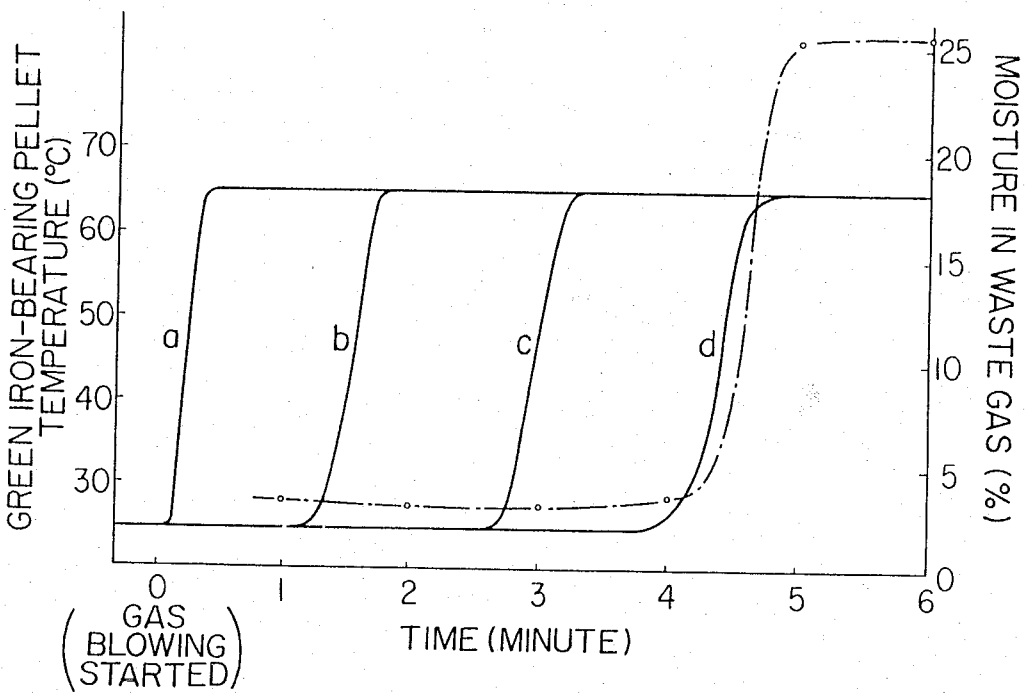
FIG. 2 is a graph illustrating the progress of the temperature of a green iron-bearing pellet in the test heating apparatus shown in FIG. 1 and the moisture contained in exhaust gas in case that the green iron-bearing pellet is heated in the test heating apparatus shown in FIG. 1.

From the above-mentioned point of view, we carried out extensive studies with a view to developing a method and an apparatus for manufacturing a non-fired iron-bearing pellet, which permit manufacture of a high-quality non-fired iron-bearing pellet in a short time at a low cost.

When the temperature of saturated steam decreases, part of steam is condensed, generating condensation heat. When, for example, for the purpose of heating a green iron-bearing pellet to a temperature of 100° C., a gas containing saturated steam at a temperature of 100° C. is blown into contact with the green iron-bearing pellets under ambient pressure (1 atm) to cause heat exchange with the green iron-bearing pellet, the decrease in the gas temperature to below 100° C. through this heat exchange immediately leads to condensation of part of the saturated steam contained in the gas, generating condensation heat. Thus, heat of the gas lost through heat exchange with the green iron-bearing pellet is replenished with this condensation heat, and as a result, the gas temperature is brought again to 100° C. Therefore, when using a gas containing saturated steam to heat a green iron-bearing pellet to a temperature of 100° C., a gas temperature of 100° C. would suffice. As a result, part of the green iron-bearing pellet first brought into contact with the gas is not subjected to overheating and water contained therein is never evaporated.

The present invention was made on the basis of the above-mentioned findings, and apparatus for manufacturing a non-fired iron-bearing pellet of the present invention comprises:

means for adding a hydraulic binder and water to main raw materials which comprise at least one of an iron ore fine and a dust mainly comprising iron oxides, and mixing same; the resultant mixture being formed into a green iron-bearing pellet; means for continuously supplying said green iron-bearing pellet into a treating furnace; means for blowing a gas at a prescribed temperature into said treating furnace to heat said green iron-bearing pellet to a target temperature; and, means for maintaining said green iron-bearing pellet at said target temperature for a prescribed period of time to harden said green iron-bearing pellet, thereby continuously manufacturing a non-fired iron-bearing pellet;

characterized in that:

said target temperature for heating a green iron-bearing pellet is set within the range of from 50° to 100° C.;

said gas contains a saturated steam, and the temperature of said gas is substantially equal to said target temperature;

whereby at least part of said steam contained in said gas generates a condensation heat by condensation through heat exchange with a green iron-bearing pellet in said treating furnace, and thus, heat of said gas lost through said heat exchange with said green iron-bearing pellet is replenished with said condensation heat.

The target temperature for heating a green iron-bearing pellet should be within the range of from 50° to 100° C. More specifically, if the temperature exceeds 100° C., the green iron-bearing pellet is overheated and water contained therein is evaporated under the ambient pressure (1 atm), thus preventing a proper hydration reaction from taking place and making it impossible to manufacture a high-quality non-fired iron-bearing pellet. If the temperature is under 50° C., on the other hand, a long time is required for hardening the green iron-bearing pellet, and it is impossible to manufacture a non-fired iron-bearing pellet in a short time.

The gas to be blown into the treating furnace for heating a green iron-bearing pellet contains saturated steam and should have a temperature substantially equal to the above-mentioned heating target temperature of the green iron-bearing pellet. If, for example, the target temperature for heating a green iron-bearing pellet is set at 70° C., the gas blown into the treating furnace should contain saturated steam and have a temperature of substantially 70° C. When the temperature of the gas decreases through heat exchange with the green iron-bearing pellet in the treating furnace, at least part of steam contained in the gas is condensed to generate condensation heat. Thus, heat of the gas lost through heat exchange with the green iron-bearing pellet is replenished with the condensation heat. As a result, the gas temperature is brought again to 70° C. by the effect of the above condensation heat of the steam, and hence, it is possible to rapidly heat the green iron-bearing pellet to a temperature of 70° C. with this gas.

The above-mentioned phenomenon may be expressed by the following equation (2):

$$C_s M_s (T_{s1} - T_{so}) = \int_0^T F\left(Y_1 - \frac{1 - Y_1}{1 - Y_o} \cdot Y_o\right) \rho_{H2O} \Delta H_{ev} dt \quad (2)$$

where $Y_o$: molar fraction of steam corresponding to saturated steam pressure at the temperature before heating of the green iron-bearing pellet;

$Y_1$: molar fraction of steam corresponding to saturated steam pressure at the target temperature for heating the green iron-bearing pellet;

$\rho_{H2O}$: density (kg/Nm$^3$) under normal condition of steam; and, $\Delta H_{ev}$: condensation heat at the target temperature for heating the green iron-bearing pellet (Kcal/kg).

When, for example, a ton of green iron-bearing pellets at a temperature of 30° C. is heated by 60° C. to the heating target temperature of 90° C. through blowing of a gas at a temperature of 60° C. containing saturated steam by this method, the required quantity $F_\tau$ of the blown gas, as calculated by the above-mentioned equation (2), is only 32 Nm$^3$ as shown below, and is thus far smaller than that required in the case of the above-mentioned conventional method:

$$\underset{(C_s)}{0.16} \times \underset{(M_s)}{1000} \times \underset{(T_{sl} - T_{so})}{60} = F_\tau \left(\underset{(Y_1)}{0.692} - \frac{1 - 0.692}{1 - \underset{(Y_o)}{0.042}} 0.042\right) \times \underset{(\rho_{H2O})}{0.804} \times \underset{(\Delta H_{ev})}{545}$$

$$F_\tau = 32$$

The temperature of the gas to be blown into the treating furnace can be previously set at a temperature higher by for example about 5° C. than the target temperature for heating the green iron-bearing pellet, since the gas may sometimes be cooled before reaching the treating furnace, leading to a lower temperature. So far as the saturation pressure of the saturated steam contained in the gas is 1 atm, the upper limit of the gas temperature is 100° C. It is however possible to increase this temperature to slightly over 100° C. by increasing the saturation pressure to over 1 atm.

Preheating of the green iron-bearing pellet to a temperature within the range of from 40° to 90° C. prior to heating the same to the above-mentioned target temperature within the range of from 50° to 100° C. is effective in increasing the strength of the green iron-bearing pellet. This preheating may be conducted either in the treating furnace for heating the green iron-bearing pellet, or outside the above-mentioned treating furnace, but the most effective way is to preheat the green iron-bearing pellet in the treating furnace with the use of the gas after heating of the green iron-bearing pellet to said target temperature, prior to heating the green iron-bearing pellet to the target temperature in the treating furnace.

Furthermore, drying of the green iron-bearing pellet heated to the target temperature with a gas at a temperature within the range of from 100° to 300° C. is effective in increasing the strength thereof. In this case, a gas temperature of under 100° C. can give only a limited drying effect, whereas a gas temperature of over 300° C. leads rather to a lower strength. This drying of the green iron-bearing pellet may be effected either in the treating furnace or outside the treating furnace.

Now, the present invention is described by means of examples.

EXAMPLE 1

Figure 1:
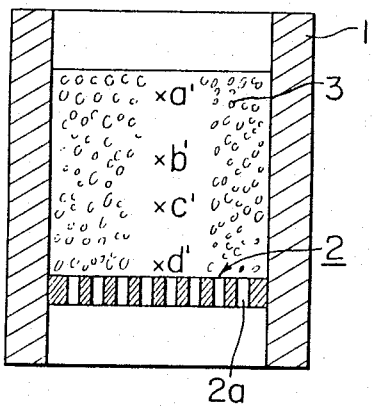
FIG. 1 is a schematic longitudinal sectional view of a test heating apparatus illustrating the apparatus of the present invention.

FIG. 1 is a schematic longitudinal sectional view of a test heating apparatus 1 illustrating the apparatus of the present invention. In FIG. 1, the heating apparatus 1 has a cylindrical shape with a diameter of 700 mm, and is provided with a plurality of vent holes 2*a* on the bottom 2 thereof. A non-fired iron-bearing pellet was manufactured by charging a green iron-bearing pellet 3 into the test heating apparatus 1 to a height of 995 mm from the bottom 2 thereof, and blowing a gas containing a saturated steam into the test heating apparatus 1 from above to heat and harden the green iron-bearing pellet in the test heating apparatus 1. The manufacturing conditions were as follows:

| | |
|---|---|
| (1) Composition of the green iron-bearing pellet: | |
| Iron ore fine: (hematite pellet feed) | 90 wt. % |
| Portland cement: | 10 wt. % |
| (2) Diameter of the green iron-bearing pellet: | from 10 to 17 mm (13.5 mm on the average) |
| (3) Water contained in the green iron-bearing pellet: | 8 wt. % (wet basis) |
| (4) Charging temperature of the green iron-bearing pellet: | 25° C. |
| (5) Target temperature for heating the green iron-bearing pellet: | 65° C. |
| (6) Quantity of charged green iron-bearing pellet: | 810 kg (dry basis) |
| (7) Blown gas: | An air of 65° C. containing a saturated steam |
| (8) Amount of blown gas: | |
| Air: | 5.2 $Nm^3$/min. |
| Steam: | 1.38 kg/min. |
| (9) Blown gas temperature: | 70° C. |
| (10) Velocity of blown gas passing through the test heating apparatus: | 0.377 m/sec. |
| (11) Pressure in the test heating apparatus: | 1 atm. |

FIG. 2 is a graph illustrating the progress of the temperature of a green iron-bearing pellet in the test heating apparatus and the moisture contained in the exhaust gas in case that the green iron-heating pellet is heated under the above-mentioned conditions. In FIG. 2, the solid lines "a", "b", "c" and "d" represent the temperature at the respective positions in the test heating apparatus 1 of the green iron-bearing pellet 3 supplied into the test heating apparatus 1 shown in FIG. 1. More particularly, the solid line "a" indicates the temperature at the part a' at a depth of 40 mm from the upper surface of the green iron-bearing pellet 3 supplied into the test heating apparatus 1, the solid line "b" indicates that at the part b' at a depth of 330 mm, the solid line "c", the part c' at a depth of 670 mm, and the solid line "d", the part d' at a depth of 995 mm. In FIG. 2, the single-point chain line represents the moisture contained in the exhaust gas discharged from vent holes 2*a* of the heating apparatus shown in FIG. 1.

As is clear from FIG. 2, the temperature of the green iron-bearing pellet 3 supplied into the test heating apparatus 1 shown in FIG. 1 did not exceed the heating target temperature of 65° C. at any position in the test heating apparatus 1, with a water content in the green iron-bearing pellet of 9.4% after heating for 6 minutes, thus enabling to manufacture a high-quality non-fired iron-bearing pellet. The consumption of the air and steam blown during the heating time of 5 minutes was 32.1 $Nm^3$ per ton of the green iron-bearing pellet for the air, and 8.5 kg per ton of the green iron-bearing pellet for the steam.

EXAMPLE 2

Figure 3:
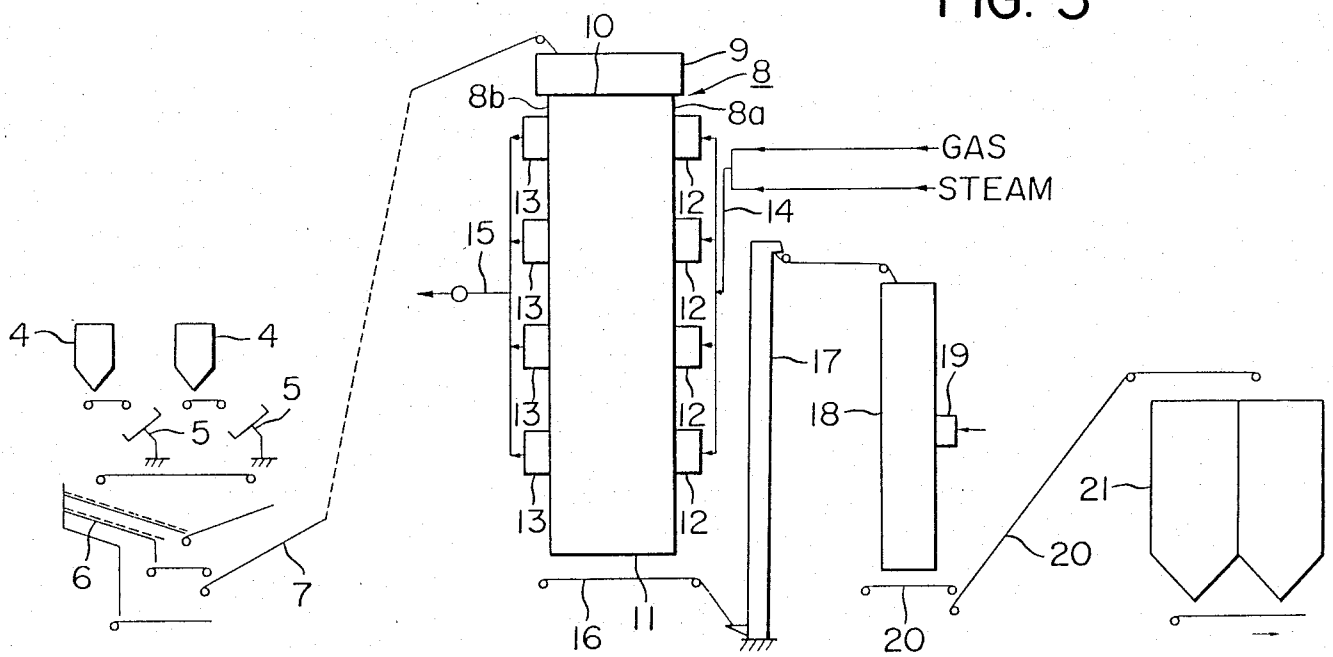
FIG. 3 i a schematic view illustrating an embodiment of the apparatus used in the method of the present invention.

FIG. 3 is a schematic drawing illustrating an embodiment of the apparatus used in the method of the present invention. In Example 2, the treating furnace comprises a shaft furnace. In FIG. 3, 4 is a storage bin for raw materials; 5 is a pelletizer; 6 is a screen; 7 is a conveyor; and, 8 is a shaft furnace. An iron ore fine mixed with a Portland cement which was a hydraulic binder and water was supplied alternately from the storage bins 4 to the pelletizers 5 and granulated in the pelletizers 5. A green iron-bearing pellet thus prepared was sieved through the screen 6, and the resultant green iron-bearing pellet with a prescribed particle size was transferred on the conveyor 7 to above the shaft furnace 8 and continuously supplied into the shaft furnace 8 through a feeding apparatus 9 installed above the shaft furnace 8.

The shaft furnace 8 is provided with a green iron-bearing pellet inlet 10 at the top thereof and a non-fired iron-bearing pellet outlet 11 at the bottom thereof. The shaft furnace 8 is adapted to contain and heat a green iron-bearing pellet continuously supplied from the green iron-bearing pellet inlet 10 into the shaft furnace 8. The shaft furnace 8 has on opposite side walls thereof 8*a* and 8*b* a plurality of heating gas blowing ports 12 and a plurality of heating gas discharge ports 13. The heating gas blowing ports 12 are adapted to blow into the shaft furnace 8 a heating gas for heating the green iron-bearing pellet supplied into the shaft furnace 8. The heating gas discharge ports 13 are adapted to discharge the heating gas after heating of the green iron-bearing pellet from the shaft furnace 8.

The heating gas at a temperature of 65° C. containing saturated steam was blown from the heating gas blowing ports 12 into the shaft furnace 8 in a direction perpendicular to the flow of the green iron-bearing pellet in the shaft furnace 8 to heat the green iron-bearing pellet therein. When the temperature of the heating gas decreased through heat exchange with the green iron-bearing pellet, at least part of steam contained in the heating gas generated condensation heat through condensation thereof, and the heat of the heating gas lost through heat exchange with the green iron-bearing pellet was replenished with the condensation heat to keep the heating gas temperature at 65° C. The green iron-bearing pellet was thus heated by the heating gas to 65° C. and hardened in the shaft furnace 8 during the period up to discharge through the non-fired iron-bearing pellet outlet 11 in the form of a non-fired iron-bearing pellet.

The non-fired iron-bearing pellet discharged from the non-fired non-bearing pellet outlet 11 was supplied on a conveyor 16 and a bucket elevator 17 into a drying oven 18 where the non-fired iron-bearing pellet was dried with a drying gas at a temperature of 200° C. blown through a drying gas blowing port 19. The non-fired iron-bearing pellet thus dried was discharged from the drying oven 18, transferred on another conveyor 20 to a storage bin 21 where the non-fired iron-bearing pellet was stored.

Figure 4:
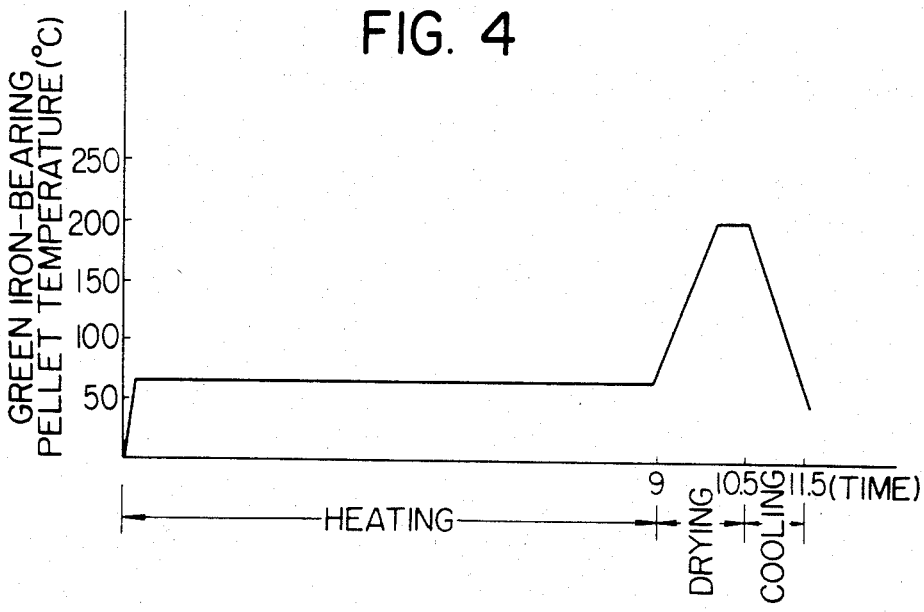
FIG. 4 is an example of heat pattern when manufacturing an iron-bearing pellet in the apparatus of the present invention shown in FIG. 3.

FIG. 4 is an example of heat pattern in case that an iron-bearing pellet having compression strength of at least 100 kg per pellet was manufactured in the apparatus shown n FIG. 3. A green iron-bearing pellet supplied into the shaft furnace 8 was heated with the heating gas at a temperature of 65° C. containing a saturated steam for a period of 9 hours, discharged from the shaft furnace 8, then dried with air at a temperature of 200° C. in the drying oven 18 for a period of one hour and 30 minutes, and cooled with air at a temperature of 20° C. for one hour to manufacture a non-fired iron-bearing pellet.

EXAMPLE 3

Figure 5:
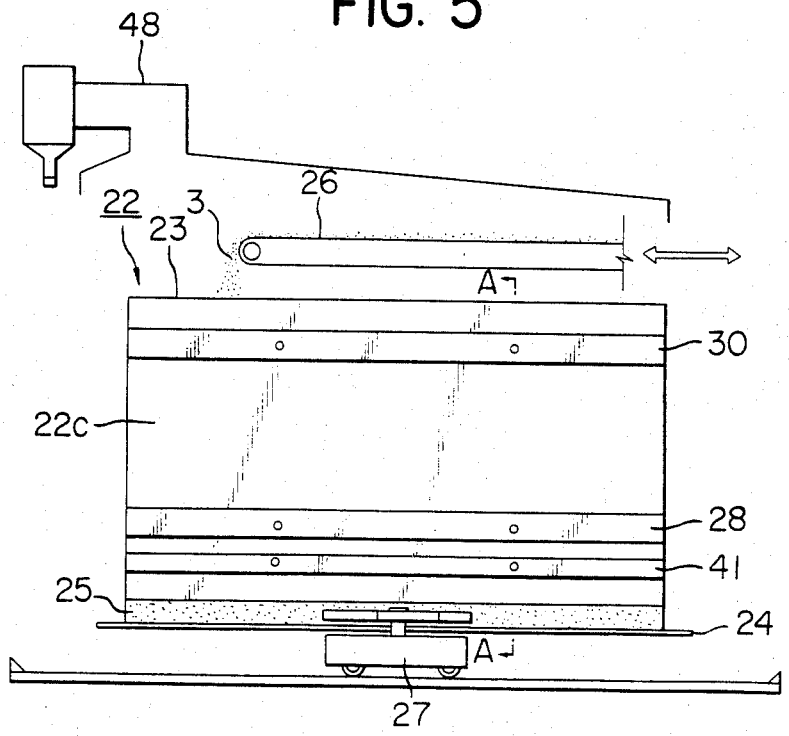
FIG. 5 is a schematic front view illustrating another embodiment of the apparatus used in the method of the present invention.
Figure 6:
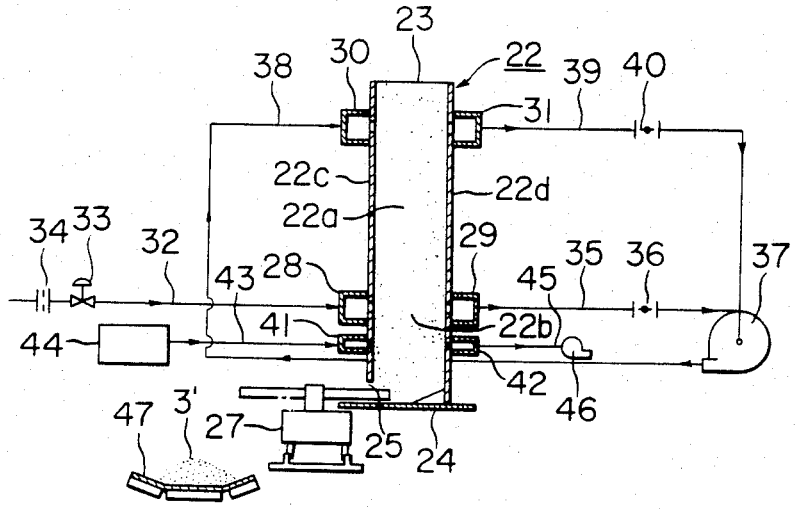
FIG. 6 is a schematic sectional view of FIG. 5 as cut along the line A—A.

FIG. 5 is a schematic front view illustrating another embodiment of the apparatus used in the method of the present invention, and FIG. 6 is a schematic sectional view of FIG. 5 as cut along the line A—A. In Example 3, the treating furnace comprises a shaft furnace 22. In FIGS. 5 and 6, the shaft furnace 22 has, for example, a height of 9 m, a width of 1.75 m and a length of 12 m. The shaft furnace 22 is provided with a green iron-bearing pellet inlet 23 over substantially the entire length of the shaft furnace 22 at the top thereof, and a non-fired iron-bearing pellet outlet 25 over substantially the entire length of the shaft furnace 22 at the bottom thereof along a bottom plate 24. In FIGS. 5 and 6, 26 is a feeder movable along the green iron-bearing pellet inlet 23 for supplying a green iron-bearing pellet 3 into the shaft furnace 22; 27 is a pellet remover of the rotating blade type movable along the non-fired iron-bearing pellet outlet 25 for discharging a non-fired iron-bearing pellet from the shaft furnace 22; 47 is a conveyor for transferring a non-fired iron-bearing pellet; and, 48 is a dust collector installed above the shaft furnace 22.

The shaft furnace 22 comprises an upper preheating zone 22*a* and a lower heating zone 22*b* following the preheating zone 22*a*. The heating zone 22*b* has on opposite side walls thereof 22*c* and 22*d* respectively a heating gas blowing port 28 and a heating gas discharge port 29. The preheating zone 22*a* has on opposite side walls thereof 22*c* and 22*d* respectively a preheating gas blowing port 30 and a preheating gas discharge port 31. The heating gas blowing port 28 is connected with a heating gas supply pipe 32 and the heating gas supply pipe 32 is connected through a valve 33 to a steam feeder 34. The heating gas discharge port 29 is connected with a heating gas discharge pipe 35 for discharging through the heating gas discharge port 29 the heating gas blown from the heating gas blowing port 28 into the heating zone 22*b*, and the heating gas discharge pipe 35 is connected through a first valve 36 to a suction port of a blower 37. The preheating gas blowing port 30 is connected with a preheating gas supply pipe 38, and the preheating gas supply pipe 38 is connected to a blowing port of the blower 37. The preheating gas discharge port 31 is connected with a preheating gas discharge pipe 39 for discharging through the heating gas discharge port 31 the preheating gas blown from the preheating gas blowing port 30 into the preheating zone 22*a*. The preheating gas discharge pipe 39 is connected through a second valve 40 to the suction port of the blower 37.

The heating gas blown through the heating gas supply pipe 32 and the heating gas blowing port 28 into the heating zone 22*b* heats the green iron-bearing pellet 3 in the heating zone 22*b*, and then discharged through the heating gas discharge port 29 into the heating gas discharge pipe 35. The heating gas discharged into the heating gas discharge pipe 35 is introduced, together with the preheating gas discharged from the preheating gas discharge port 31, into the preheating gas discharge pipe 39 through the blower 37, the preheating gas supply pipe 38 and the preheating gas blowing port 30, into the preheating zone 22*a*, and, after preheating the green iron-bearing pellet in the preheating zone 22*a*, discharged from the preheating gas discharge port 31 into the preheating gas discharge pipe 39. The preheating gas discharged into preheating gas the discharge pipe 39 is introduced again, together with the heating gas discharged from the heating gas discharge port 29, into the preheating zone 22*a*, and is thus used in recycle.

The shaft furnace 22 further has on opposite side walls thereof 22*c* and 22*d* at the lowermost parts a drying gas blowing port 41 and a drying gas discharge port 42 respectively. The drying gas blowing port 41 is connected with a drying gas supply pipe 43 which is in turn connected to a drying gas feeder 44. The drying gas discharge port 42 is connected with a drying gas discharge pipe 45 which is in turn connected to a blower 46.

Now, the following paragraphs describe a case where a non-fired iron-bearing pellet was manufactured with the use of the above-mentioned apparatus.

A green iron-bearing pellet 3 prepared by granulating a mixture comprising an iron ore fine mixed with a fine powdery granulated slag as the hydraulic binder and water, was continuously supplied by means of the feeder 26 into the shaft furnace 22 through the green iron-bearing pellet inlet 23 at the top thereof. The preheating gas at a temperature of 70° C. containing saturated steam was blown from the preheating gas blowing port 30 to the green iron-bearing pellet 3 supplied into the preheating zone 22*a* of the shaft furnace 22, in a direction perpendicular to the flow of the green iron-bearing pellet 3 to preheat the green iron-bearing pellet 3 in the preheating zone 22*a*. When the temperature of the preheating gas descreased through heat exchange with the green iron-bearing pellet 3, at least part of steam contained in the preheating gas was condensed to generate condensation heat, and thus, the heat of the preheating gas lost through heat exchange with the green iron-bearing pellet 3 was replenished with this condensation heat and the temperature of the preheating gas was kept at 70° C. The green iron-bearing pellet 3 was thus preheated to a temperature of 70° C. by the preheating gas while descending through the preheating zone 22*a*.

The heating gas at a temperature of 100° C. containing saturated steam was blown through the heating gas blowing port 28 to the green iron-bearing pellet 3 having thus descended through the preheating zone 22*a* and moved into the heating zone 22*b* to heat the green iron-bearing pellet 3 with this heating gas. The green iron-bearing pellet 3 was heated to 100° C. by the heating gas while descending through the heating zone 22*b*. Then, the drying gas at a temperature of 250° C. was blown from the drying gas blowing port 41 to the green iron-bearing pellet 3 thus heated to 100° C. to dry the green iron-bearing pellet 3.

Thus, the green iron-bearing pellet 3 supplied into the shaft furnace 22 through the green iron-bearing pellet inlet 23 at the top thereof preheated in the preheating zone 22*a* and then heated in the heating zone 22*b* while descending through the shaft furnace 22, and dried and hardened with the drying gas into a non-fired iron-bearing pellet 3'. The non-fired iron-bearing pellet 3' was discharged from the non-fired iron-bearing pellet outlet 25 by the pellet remover 27, transferred on the conveyor 47 to the storage bin, and cooled while being thus transferred.

Part of the preheating gas at a temperature of 70° C. containing saturated steam blown into the preheating zone 22*a* descended, together with the green iron-bearing pellet 3 preheated to 70° C., through the preheating zone 22*a* to the heating zone 22*b*, and was discharged through the heating gas discharge port 29 of the heating zone 22*b*. Therefore, the atmosphere in the preheating zone 22*a* could be kept in a gaseous atmosphere of 70° C. containing saturated steam. Since, in the preheating zone 22*a* as well as in the heating zone 22*b*, the gases blown had a temperature of under 100° C., the green iron-bearing pellet was not overheated, thus preventing water contained in the green iron-bearing pellet from being evaporated before hardening of the green iron-bearing pellet.

In the above-mentioned preheating and heating of the green iron-bearing pellet 3, the temperature of the preheating gas at a temperature of 70° C. containing saturated steam blown from the preheating gas blowing port 30 decreased to 65° C. when the preheating gas was discharged from the preheating gas discharge port 31 after preheating the green iron-bearing pellet 3. The temperature of the heating gas at a temperature of 100° C. containing saturated steam blown from the heating gas blowing port 28 decreased to 85° C. when the heating gas was discharged from the heating gas discharge port 29 after heating the green iron-bearing pellet 3. Therefore, the preheating gas at a temperature of 70° C. containing saturated steam to be blown from the preheating gas blowing port 30 into the preheating zone 22*a* could be easily obtained by mixing the preheating gas discharged from the preheating gas discharge port 31 and the heating gas discharged from the heating gas discharge port 29 at a prescribed ratio through adjusting the first and second valves 36 and 40.

Figure 7:
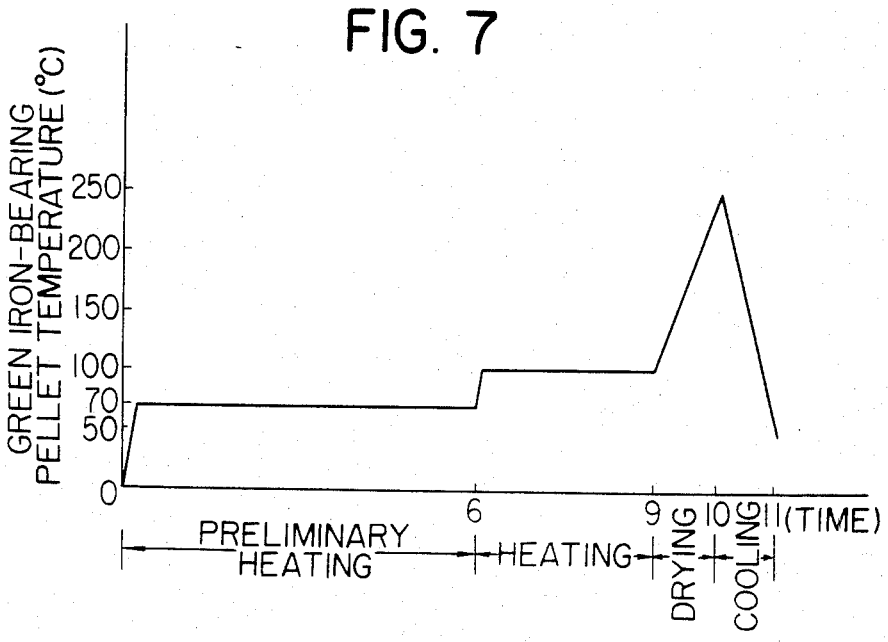
FIG. 7 is an example of heat pattern when manufacturing an iron-bearing pellet in the apparatus of the present invention shown in FIGS. 5 and 6; and, FIG. 8 is a schematic sectional view illustrating further another embodiment of the apparatus of the present invention.

FIG. 7 is an example of heat pattern in case that a non-fired iron-bearing pellet having compression strength of over 100 kg per pellet was manufactured by the method described above. The green iron-bearing pellet 3 supplied into the shaft furnace 22 was preheated for a period of six hours in the preheating zone 22*a* with the preheating gas at a temperature of 70° C. containing saturated steam, then heated for a period of three hours in the heating zone 22*b* with the heating gas at a temperature of 100° C. containing saturated steam, then dried for a period of one hour at a temperature of 250° C., and then cooled for a period of one hour with air at a temperature of 20° C., thus permitting manufacture of a non-fired iron-bearing pellet 3'.

Typical manufacturing conditions of non-fired iron-bearing pellet in the above-mentioned apparatus as shown in FIGS. 5 and 6 are as follows:

| | | |
|---|---|---|
| (1) | Green iron-bearing pellet supplied into the shaft furnace: | |
| | Temperature: | 30° C. |
| | Water content: | 8 wt. % |
| | Quantity supplied: | 45,290 kg/Hr |
| (2) | Preheating gas blown into the preheating zone: | |
| | Temperature: | 70° C. |
| | Quantity supplied: | 6,586 kg/Hr |
| | Air: | 5,160 kg/Hr |
| | Steam: | 1,426 kg/Hr |
| (3) | Preheating gas discharged from the preheating zone: | |
| | Temperature: | 50° C. |
| | Quantity discharged: | 4,166 kg/Hr |
| | Air: | 3,835 kg/Hr |
| | Steam: | 331 kg/Hr |
| (4) | Green iron-bearing pellet and preheating gas in the preheating zone: | |
| | Temperature: | 70° C. |
| | Quantity of green iron-bearing pellet: | 45,290 kg/Hr |
| | Quantity of preheating gas: | 1,691 kg/Hr |
| | Air: | 1,325 kg/Hr |
| | Steam: | 366 kg/Hr |

-continued

| | | |
|---|---|---|
| (5) | Heating gas blown into the heating zone: | |
| | Temperature: | 100° C. |
| | Quantity blown: | 1,361 kg/Hr (steam) |
| (6) | Heating gas discharged from the heating zone: | |
| | Temperature: | 85° C. |
| | Quantity discharged: | 2,420 kg/Hr |
| | Air: | 1,325 kg/Hr |
| | Steam: | 1,095 kg/Hr |
| (7) | Non-fired iron-bearing pellet discharged from the shaft furnace: | |
| | Temperature: | 100° C. |
| | Quantity discharged: | 45,290 kg/Hr |

EXAMPLE 4

Figure 8:
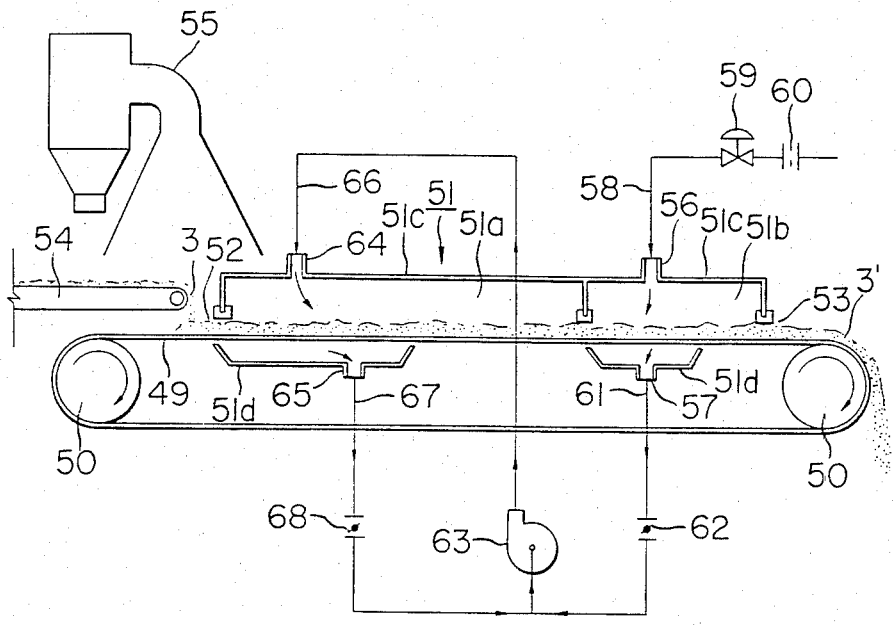

FIG. 8 is a schematic sectional view illustrating further another embodiment of the apparatus used in the method of the present invention. In Example 4, the treating furnace comprises a heating chamber 51 and a green iron-bearing pellet transfer mechanism comprising a pair of pulleys 50 and an endless travelling grate 49. The heating chamber 51 is provided with a green iron-bearing pellet inlet 52 at an end thereof and a non-fired iron-bearing pellet outlet 53 at the other end thereof. The endless travelling grate 49 is adapted to pass continuously through the heating chamber 51 in the horizontal direction and continuously travel a green iron-bearing pellet 3, which is continuously supplied from the green iron-bearing pellet inlet 52 onto the endless travelling grate 49, through the heating chamber 51. In FIG. 8, 54 is a feeder for supplying the green iron-bearing pellet 3 to the green iron-bearing pellet inlet 52; and 55 is a dust collector installed above the green iron-bearing pellet inlet 52.

The heating chamber 51 comprises a preheating zone 51*a* and a heating zone 51*b* following the preheating zone 51*a*. The endless travelling grate 49 continuously passes sequentially through the preheating zone 51*a* and the heating zone 51*b*. The heating zone 51*b* is provided with a heating gas blowing port 56 and a heating gas discharge port 57 on the upper and lower walls 51*c* and 51*d* thereof respectively, which walls 51*c* and 51*d* put the endless travelling grate 49 therebetween. The heating gas blowing port 56 is connected with a heating gas supply pipe 58 which is in turn connected through a valve 59 to a steam feeder 60. The heating gas discharge port 57 is connected with a heating gas discharge pipe 61 which is in turn connected through a first valve 62 to a suction port of a blower 63.

The preheating zone 51*a* is provided with a preheating gas blowing port 64 and a preheating gas discharge port 65 on the upper and lower walls 51*c* and 51*d* thereof respectively with the endless travelling grate 49 therebetween. The preheating gas blowing port 64 is connected with a preheating gas supply pipe 66 which is in turn connected to a blowing port of the blower 63. The preheating gas discharge port 65 is connected with a preheating gas discharge pipe 67 which is in turn connected through a second valve 68 to the suction port of the blower 63.

The heating gas blown through the heating gas supply pipe 58 and the heating gas blowing port 56 into the heating zone 51*b* heats the green iron-bearing pellet 3 on the endless travelling grate 49 which travels through the heating zone 51*b*, and is then discharged from the heating gas discharge port 57 into the heating gas discharge pipe 61. The heating gas discharged into the heating gas discharge pipe 61 is blown, together with the preheating gas discharged from the preheating gas discharge port 65, into the preheating gas discharge pipe 67 through the preheating gas supply pipe 66 and the preheating gas blowing port 64, into the preheating zone 51*a*, preheats the green iron-bearing pellet 3 on the endless travelling grate 49 whih travels through the preheating zone 51*a*, and is then discharged from the preheating gas discharge port 65 into the preheating gas discharge pipe 67. The preheating gas discharged into the preheating gas discharge pipe 67 is introduced, again together with the heating gas discharged from the heating gas discharge port 57, into the preheating zone 51*a*, and thus used in recycle.

Now, the following paragraphs described a case where a non-fired iron-bearing pellet was manufactured with the use of the above-mentioned apparatus.

In the apparatus used, the preheating zone 51*a* had a length of 25 m and an area of 125 $m^2$, the heating zone 51*b* had a length of 12.5 m and an area of 62.5 $m^2$, and the endless travelling grate 49 had a width of 5 m. A non-fired iron-bearing pellet was manufactured in this apparatus with a travelling speed of the endless travelling grate 49 of 4.2 m/Hr. A green iron-bearing pellet 3 was continuously supplied from the feeder 54 through the green iron-bearing pellet inlet 52 into the preheating zone 51*a* of the heating chamber 51. The preheating gas at a temperature of 70° C. containing saturated steam was blown from the preheating gas blowing ort 64 to the green iron-bearing pellet 3, travelling on the endless travelling grate 49 through the preheating zone 51*a*, in a direction perpendicular to the flow of the green iron-bearing pellet 3, to preheat the green iron-bearing pellet 3 in the preheating zone 51*a*. The green iron-bearing pellet 3 was preheated to a temperature of 70° C. by the preheating gas while travelling through the preheating zone 51*a*. Then, the heating gas at a temperature of 100° C. containing saturated steam was blown from the heating gas blowing port 56 to the green iron-bearing pellet 3, travelling through the heating zone 51*b*, in a direction perpendicular to the flow of the green iron-bearing pellet 3, to heat the green iron-bearing pellet 3 in the heating zones 51*b*. The green iron-bearing pellet 3 was heated to a temperature of 100° C. and hardened by the heating gas while travelling through the heating zone 51*b*, into a non-fired iron-bearing pellet 3'. The non-fired iron-bearing pellet 3' was discharged through the non-fired iron-bearing pellet outlet 53 and dried in a drying oven (not shown).

The green iron-bearing pellet 3 supplied into the heating chamber 51 was prepared by granulating a mixture comprising an iron ore fine mixed with a fine powdery granulated slag as the hydraulic binder and water. The green iron-bearing pellet had a temperature of 30° C., with a water content of 8 wt.%, and was supplied into the heating chamber 51 in an amount of 45,290 kg/Hr. The other conditions including those for the preheating gas blown into the preheating zone 51*a* and the heating gas blown into the heating zone 51*b* were the same as the conditions in Example 3. The heating chamber may comprise only a heating zone, not divided into preheating and heating zones as in Example 4.

In Examples 2 to 4 described above, forcible drying of the heated and hardened green iron-bearing pellet is not always necessary, but the heated and hardened green iron-bearing pellet may be dried through spontaneous drying. It is possible to prevent occurrence of a trouble caused by an excessive water content in the green iron-bearing pellet by drying the green iron-bearing pellet prior to charging into the treating furnace. It is also possible to prevent scaffolding from occurring in the treating furnace by supplying the heated and hardened non-fired iron-bearing pellet together with the green iron-bearing pellet, into the treating furnace at a prescribed ratio.

Preheating and heating of a green iron-bearing pellet in the treating furnace are not limited to the two-stage process as in the above-mentioned Examples 2 to 4, but may be carried out in three stages of, for example, 50° C., 70° C. and 100° C., or in four stages of, for example, 50° C., 70° C., 90° C. and 100° C. In all cases, mixing the preheating gas discharged from the preheating zone and the heating gas discharged from the heating zone, and using the thus mixed gas in recycle permit blowing of a preheating gas at a desirable temperature into the preheating zone and elimination of the necessity of a dust collector through prevention of release of the waste gas to open air. Blowing of the heating gas and the preheating gas into the treating furnace in a direction perpendicular to the flow of the green iron-bearing pellet allows effecitve and uniform heating of the green iron-bearing pellet in a simple apparatus.

The above-mentioned Examples 2 to 4 have covered the cases of manufacture of a non-fired iron-bearing pellet, but it is needless to mention that the method and the apparatus of the present invention may well be applicable also to the manufacture of a non-fired pellet of a manganese ore fine or a chromium ore fine.

According to the method and the apparatus for manufacturing a non-fired iron-bearing pellet of the present invention, as described above in detail, it is possible to manufacture a high-quality non-fired iron-bearing pellet with a small quantity of a preheating gas and a heating gas in a short time, without using a gas at a temperature higher than the heating target temperature of a green iron-bearing pellet at a low cost, thus providing many industrially useful effects.

What is claimed is:

1. An apparatus for manufacturing non-fired iron-bearing pellets which comprises:

a treating furnace having a green iron-bearing pellet inlet at one end thereof and a non-fired iron-bearing pellet outlet at the other end thereof, said treating furnace comprising:

a source of preheating gas;

a preheating zone coupled to said preheating gas source for preheating green iron-bearing pellets which are continuously supplied from said green iron-bearing pellet inlet into said treating furnace to a temperature of from 40° to 90° C.;

a source of heating gas;

a heating zone following said preheating zone and coupled to said heating gas source, for heating the thus preheated green iron-bearing pellets by means of said heating gas which contains saturated steam under atmospheric pressure and has a temperature of from 50° to 100° C., said heating gas converting said green iron-bearing pellets into non-fired iron-bearing pellets, the green iron-bearing supplied from said green iron-bearing pellet inlet into said treating furnace passing sequentially and continuously through said preheating zone and said heating zone;

said preheating zone comprising a preheating gas blowing port through which said preheating gas is blown into said preheating zone to thereby preheat the green iron-bearing pellets therein, and a preheating gas discharge port through which said preheating gas after the completion of said preheating of the green iron-bearing pellets in said preheating zone is discharged;

said heating zone having a heating gas blowing port through which said heating gas is blown into said heating zone to heat the green iron-bearing pellets therein, and a heating gas dischrge port through which said heating gas after the completion of said heating of the green iron-bearing pellets in said heating zone is discharged;

means for blowing said heating gas from said heating gas blowing port into said heating zone of said treating furnace; and a blower (37,63) for blowing said preheating gas from said preheating gas blowing port into said preheating zone of said treating furnace, said blower having a suction port and a blowing port;

means including a first valve means (36,62) coupling and communicating said suction port of said blower (37,63) with said heating gas discharge port (29,57) of said heating zone (**22*b*,53*b***);

means including a second valve means (40,68) coupling and communicating said suction port of said blower (37,63) with said preheating gas discharge port (31,65) of said preheating zone (**22*a*,51*a*); and means for communicating said blowing port of said blower (37,63) with said preheating gas blowing port (30,64) of said preheating zone (22*a*,51*a***);

whereby said heating gas which had been used to heat the green iron-bearing pellets (3) in said heating zone (**22*b*,51*b*) and said preheating gas which had been used to preheat the green iron-bearing pellete (3) in said preheating zone (22*a*,51*a*) are mixed in said blower (37,63) at a ratio sufficient to give the desired preheating temperature to prepare the preheating gas which is used to preheat the green iron-bearing pellets (3) in said preheating zone (22*a*,51*a*) by controllably operating said first valve means (36,62) and said second valve means (40,68) to form said preheating gas which is recirculated into said preheating zone (22*a*,51*a*) by means of said blower (37,63) to preheat the greeb iron-bearing pellets (3) in said preheating zone (22*a*,51*a***).

2. The apparatus as claimed in claim 1, wherein:

said treating furnace comprises a shaft furnace (22), said shaft furnace (22) having said green iron-bearing pellet inlet (23) at the top thereof and said non-fired iron-bearing pellet outlet (25) at the bottom thereof, said shaft furnace (22) comprising said preheating zone (**22*a*) in the upper portion thereof and said heating zone (22*b*) following said preheating zone (22*a*) in the lower portion thereof; and the green iron-bearing pellets (3) continuously supplied from said green iron-bearing pellet inlet (23) into said shaft furnace (22) descend continuously through said preheating zone (22*a*) and said heating zone (22*b***) in this order.

3. The apparatus as claimed in claim 1, wherein:

said treating furnace comprises a heating chamber (51) and a green iron-bearing pellet transfer mechanism comprising a pair of pulleys (50) and an endless travelling grate (49), said heating chamber (51) having said green iron-bearing pellet inlet (52) at one end thereof in the horizontal direction and said non-fired iron-bearing pellet outlet (53) at the other end thereof in the horizontal direction, said heating chamber (51) comprising said preheating zone (**51*a*) and said heating zone (51*b*) following said preheating zone (51*a*), which are arranged in the horizontal direction; and said endless travelling grate (49) continuously travelling horizontally through said preheating zone (51*a*) and said heating zone (51*b*) in this order, to continuously pass the green iron-bearing pellets (3) which are continuously supplied from said green iron-bearing pellet inlet (52) onto said endless travelling grate (49) through said preheating zone (51*a*) and said heating zone (51*b***) in this order.

* * * * *

UNITED STATES PATENT AND TRADEMARK OFFICE

CERTIFICATE OF CORRECTION

PATENT NO. : 4,515,351 PAGE 1 OF 2.

DATED : May 7, 1985

INVENTOR(S) : Michio NAKAYAMA et al

It is certified that error appears in the above-identified patent and that said Letters Patent is hereby corrected as shown below:

In the title:

Delete "METHOD AND".

Column 8, line 47, change "non-bearing" to --iron-bearing--.

Column 10, line 44, change "with this heating gas" to --in the heating zone 22b--.

Column 13, line 30, change "ort" to --port--.

Column 14, line 24, change "effecitve" to --effective--.

Column 15 (claim 1), line 10, change "dischrge" to --discharge--.

Column 15 (claim 1), line 16, delete "and".

UNITED STATES PATENT AND TRADEMARK OFFICE

CERTIFICATE OF CORRECTION

PATENT NO. : 4,515,351 PAGE 2 OF 2.

DATED : May 7, 1985

INVENTOR(S) : Michio NAKAYAMA et al

It is certified that error appears in the above-identified patent and that said Letters Patent is hereby corrected as shown below:

Column 15 (claim 1), line 24, change "53b" to --51b--.

Column 16 (claim 1), line 3, change "reeb" to --green--.

Signed and Sealed this

*Twenty-sixth* Day of *August 1986*

[SEAL]

*Attest:*

DONALD J. QUIGG

*Attesting Officer* *Commissioner of Patents and Trademarks*